United States Patent [19]

Elliesen

[11] 4,117,767

[45] Oct. 3, 1978

[54] COMPRESSED AIR-OPERATED FASTENER DRIVER

[75] Inventor: Wolfgang Elliesen, Ahrensburg, Fed. Rep. of Germany

[73] Assignee: Joh. Friedrich Behrens Aktiengesellschaft, Ahrensburg, Fed. Rep. of Germany

[21] Appl. No.: 742,904

[22] Filed: Nov. 18, 1976

[30] Foreign Application Priority Data

Jan. 20, 1976 [DE] Fed. Rep. of Germany ..... 2601836

[51] Int. Cl.[2] ..... F15B 13/042; B25C 1/04

[52] U.S. Cl. ..... 91/461; 227/130; 137/625.6

[58] Field of Search ..... 137/625.6; 227/130; 91/454, 461

[56] References Cited

U.S. PATENT DOCUMENTS 3,815,475 6/1974 Howard et al. ..... 227/130

3,871,566 3/1975 Elliesen et al. ..... 227/130

FOREIGN PATENT DOCUMENTS 1,454,826 11/1976 United Kingdom ..... 227/130

*Primary Examiner*—Martin P. Schwadron

*Assistant Examiner*—A. Michael Chambers

*Attorney, Agent, or Firm*—Beaman & Beaman

[57] ABSTRACT

The invention pertains to a compressed air-operated fastener driver utilizing a piston reciprocally mounted within a cylinder wherein a control valve at one end of the cylinder selectively opens and closes cylinder ports communicating with a compressed air source, and the control valve utilizes an exhaust passage and abutment cooperating with an exhaust valve controlling the flow through exhaust ports. The control valve positions the exhaust valve, and differential pressure areas defined on the exhaust valve assure closing of the exhaust ports during pressurization of the chamber during the working stroke reducing noise and an efficient utilization of compressed air.

2 Claims, 3 Drawing Figures

COMPRESSED AIR-OPERATED FASTENER DRIVER

BACKGROUND OF THE INVENTION

The invention pertains to compressed air drivers, and particularly pertains to a valve arrangement for such apparatus.

Conventional valve arrangements for compressed air driven apparatus utilize head valves in which the valve member is a differential piston which is arranged coaxially with respect to the working cylinder and above the stroke chamber thereof. The differential piston closes the work chamber with respect to the source of compressed air when the piston is in a lower or closed position, and when the piston is an upper position the working chamber communicates with an outlet or exhaust port. The larger of the control surfaces of the control piston is selectively biased with pressure or connected to the atmosphere by a valve which is automatic or manually controlled. Such a valve arrangement is known, and is shown in German Pat. No. 1,285,959. The disadvantage of this type of valve arrangement is that it is not free from overlapping valve operations such that communication of the compressed air reservoir with the working chamber takes place before the exhaust port is completely closed, and the working chamber is in communication with the exhaust port before the communication with the compressed air source is terminated. The operation of a valve arrangement which is not free from such valve overlapping operation results in air pressure losses due to inefficient use of compressed air, and high noise levels are produced resulting from the momentary escape of compressed air directly through the exhaust port.

A valve arrangement is known which operates without any overlapping operation as disclosed in German Pat. No. 1,478,832. With this valve arrangement a sleeve shaped crossing member sealingly surrounds the cylinder end adjacent the working stroke and the open position exposes an annular gap to the compressed air source, while in the closed position and end face closingly engages a closure member of the outlet valve. Such a valve arrangement is relatively costly, and as the valve member is in the form of a sliding cylindrical valve surrounding the working chamber the driver apparatus necessarily has a long length of height.

Further, a valve arrangement is known in which an elastic retaining lip arranged at the valve piston of a head valve is utilized which is adapted to be biased directly by the pressure of the compressed air source so that the working piston upon movement of the valve piston into the opening position will initially be retained and transported along in a upward direction until, after the outlet valve has been closed, a sufficiently high pressure builds up to release the pistion with high energy so that it may perform its working stroke. This type of valve arrangement works without overlapping in the opening phase because the inlet valve opens only after the outlet has been closed. However, during the closing operation this valve arrangement produces an overlapping operation because the outlet channel is connected to the atmosphere during the entire closing step of the valve piston. Thus, a substantial volume of air may escape directly from the compressed air source through the exhaust port.

BRIEF DESCRIPTION OF THE INVENTION

It is an object of the invention to provide a compressed air operated fastener driver having a valve arrangement which is of simple construction and produces a high driving output with a minimum of air consumption, and maintains a low sound level of exhausting air.

In the practice of the invention of the aforementioned difficulties are overcome by utilizing an exhaust valve having a valve seat arranged coaxially in a blind bore with respect to the control valve piston, and is capable of producing a sliding movement between an upper and a lower abutment and is provided with an air conducting channel which communicates with a passage defined in the control piston. The exhaust valve is provided with a pair of air pressure surfaces of differing effective area whereby under sequential operation the exhaust port will be closed by the exhaust valve in dependency upon the position of the control valve which controls the position of the exhaust valve. When the control valve closes the ports permitting air to enter the driver working chamber the control valve is at such a position that compressed air is exposed to both surfaces of the exhaust valve and the exhaust valve is positioned under the influence of the forces produced by the differential area surfaces.

In this valve arrangement the control valve is formed with a passage whereby the valve operation is completely free from overlapping sequences. When the control valve opens the primary port between the working cylinder and the compressed air source the exhaust valve will have completely closed the exhaust ports, and at the same time pressure will build up in the cylinder chamber to produce the working stroke. While this mode of operation is similar to that shown in German Pat. No. 1,284,959, the operation of the invention differs over known arrangements in that the exhaust valve moves with the control valve as the control valve moves to close the cylinder chamber charging ports, and the exhaust valve will maintain the exhaust port closed until the cylinder charging ports are closed. Thereupon, a gap will be produced between the control valve abutment engaging the exhaust valve and the exhaust valve wherein both differential area pressure surfaces of the exhaust valve will be exposed to compressed air resulting in a sliding movement of the exhaust valve which opens the exhaust ports.

The fact that the control valve utilizes an elastic seal in the closing of the cylinder ports permits a slight downward movement of the abutment surface of the control valve with respect to the exhaust valve and the gap so produced permits both surfaces of the exhaust valve to be exposed to the compressed air.

Of further advantage in the practice of the invention the control valve includes an annular sealing lip concentrically surrounding a retaining lip of the piston. This advantageous construction is also illustrated in my U.S. Pat. No. 3,871,566, but the movable exhaust valve arrangement present in the instant invention is not utilized in this patented apparatus. With respect to U.S. Pat. No. 3,871,566, the air consumption of the instant invention is 30% lower than the device of my previous patented driver.

The exhaust valve element may be designed in any suitable manner. For instance, the exhaust valve may include a flange of a diameter greater than that diameter of the portion within a blind bore formed in the cover of the driver casing, and in the disclosed embodiment, an abutment surface defined upon a projection formed on the control valve engages a flange of the exhaust valve.

BRIEF DESCRIPTION OF THE DRAWINGS

The aforementioned objects and advantages will be appreciated from the following description and accompanying drawings wherein.

DESCRIPTION OF THE PREFERRED EMBODIMENT

Figure 1:
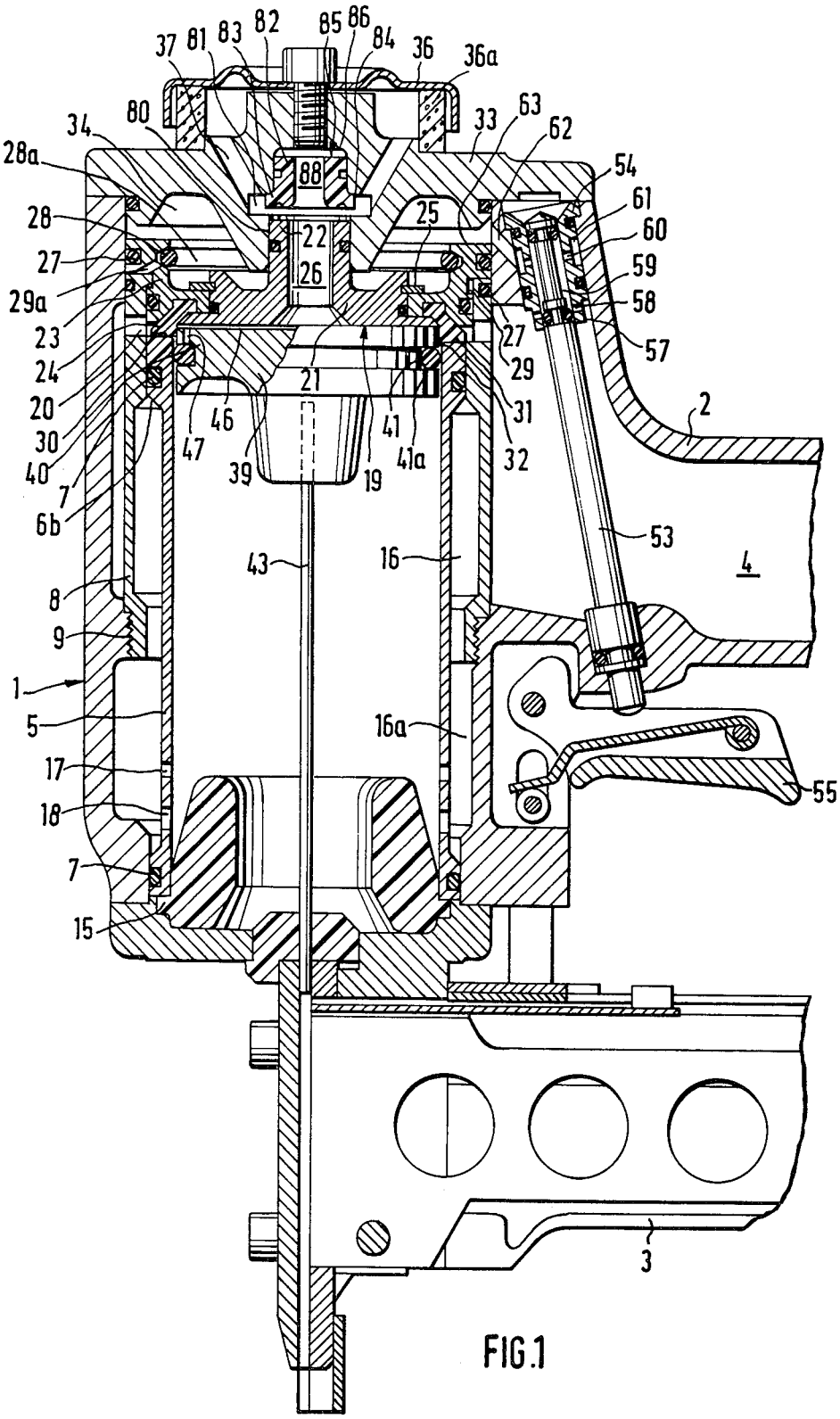
FIG. 1 is a longitudinal sectional view of a compressed air fastener driver for driving nails in accord with my invention. The valve components being shown in the normal "ready" condition.

The compressed air fastener driver shown in FIG. 1 essentially consists of three primary members, namely a housing 1, a handle 2, and the magazine 3. The handle 2 includes an inner void 4 which constitutes a compressed air reservoir receiving compressed air from a conventional source, not shown. A working cylinder 5 is defined in the housing 1 and utilizes flange reinforcements at the axial ends thereof, the upper flange being designated 6*b*. These reinforcements constitute radial guide means for the cylinder 5 and accomodate O-rings 7.

The upper half of the cylinder 5 is coaxially surrounded by a bushing 8 screwed to the housing 1 by means of thread 9. At the lower end the end face of the cylinder 5 clamps a cushioning ring 15 formed of a resilient material. Due to the axial position of the bushing 8 and the cylinder 5 there is a space 16 formed between these members which constitutes an enlargement and extension of the space 16*a*. The two spaces 16 and 16*a* accomodate the compressed air for producing the return of the piston as the piston is biased upwardly by the air it compresses during the working stroke. Bores 17 are formed in cylinder 5 permit the spaces 16 and 16*a* to function as reservoirs for the biasing compressed air, and bores 18 serve for venting purposes.

The upper region of the bushing 8 accommodates a control piston or control valve 19 of a differential pressure type. At the periphery of the bushing 8 there are several primary ports 20 through which compressed air may enter the working chamber of the cylinder 5 from the handle space 4 without loss of pressure. The control valve 19 is formed by a carrier member 21 having a tubular extension 22, a differential member 23 and a holding member 24 which are mutually assembled to each other. The holding member 24 consists of an elastic synthetic material. A spring ring 25 keeps the members 21, 23 and 24 firmly assembled. The mass of the control valve 19 is kept as small as possible so as to obtain a maximum cycle velocity.

The carrier member 21 is provided with a passage 26 extending through the extension 22. O-ring seals 27 and 41 are provided at the control valve 19 and at the housing 1, respectively, in order to seal the various compressed air spaces with respect to each other. An O-ring 28 is received in a groove 28*a* which assures that atmospheric pressure at the highest will prevail in a differential space 29. The differential space 29 is connected with a control chamber 34 through at least one bore 29*a*. The O-ring 28 blocks the bore 29*a* as soon as the pressure in the control chamber 34 increases above atmospheric pressure.

The holding ring of the control valve 19 is provided with an outer sealing lip 31 opposite an end face 30 of the cylinder 5, sealingly cooperating with the end face 30. A holding lip 32 of the holding member 24, however, which is concentrically arranged inside the sealing lip performs a holding function and clamps the upper edge of the working piston 39.

The housing 1 is closed at the end face at the upper end thereof by means of a cover 33 thereby forming the control space 34. A cap 36 serves as protection against exhaust air which escapes from the working chamber through exhaust ports 37. With the aid of the cap 36 a filter ring 36*a* of sintered metal or some other porrous material is fixed to the housing cover 33, which serves as a silencer.

The working piston 39 includes a driver rod 43 fastened thereto which is guided within a channel closed by a cover, and the piston is provided with an upper flange 40 for accomodating an O-ring 41 in a groove 41*a*. At its extreme upper position, not shown in the drawings, the position of the piston may cause the ring 41 to encounter an annular inner diameter enlargement, not shown, of the cylinder 5 in order to allow compressed air to flow from the handle space 4 through the ports 20 and the axial bores 47 terminating in the groove 41*a*, to a piston pressure chamber 46 below the control valve 19. When the piston 39 in its upper position the piston chamber 46 is formed by a groove provided in the piston.

To control the biasing pressure of the control chamber 34 above the control valve 19 an auxiliary valve is utilized consisting of a valve rod 53 and a bushing 54, the former being actuated through a control lever 55. In that portion of the control rod 53 which is disposed in the bushing 54 O-ring 65 and 57 spaced from each other are inserted in corresponding grooves to seal the bushing bore against the atmosphere and the handle space 4, respectively, which with the O-ring 57 in a corresponding position is adapted to communicate with the control chamber 34 through bore 58, and annular gap 59 between the rod 53 and the bushing 54, a bore 61 in the bushing 54 as well as a bore 62 in the housing 1. In the lifted position of the valve rod, FIG. 1, the handle space is sealed with respect to the control chamber 34 and opened to the atmosphere.

Figure 3:
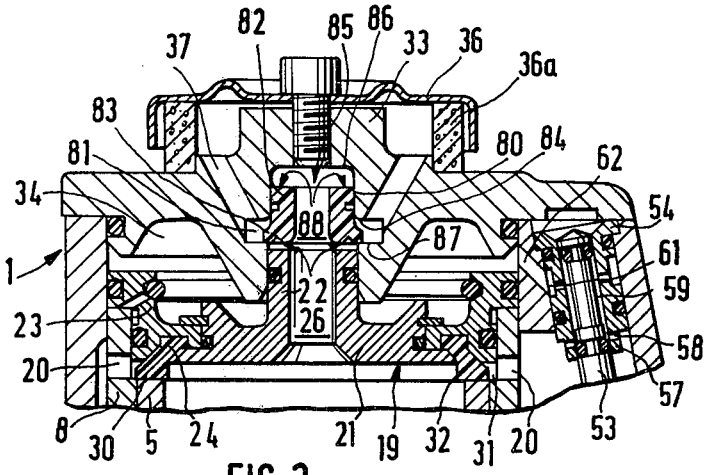

The annular extension 22 of the control valve 19 is guided in a bore 80 of the cover 33 which is provided with an enlargement 81 communicating with the exhaust ports 37. In the upper closed portion of the bore 80 an exhaust valve 82 is sealingly and slidably received, and this valve is provided with a flange 83 at the lower end thereof, and is supported at the upper wall 84 of the annular space 83 in the position shown in FIG. 1. In this position there is a control space 85 formed above the valve 82 with a control surface 86 of the valve facing it. As will be seen from FIG. 3, the flange 83 is slightly larger in diameter than the bore 80, so that, when in the lower position as shown in FIG. 3 the flange will lie closely against the lower wall 87 of the annular space 81.

The bore 88 in the exhaust valve 82 permanently communicates the control chamber 85 with the working chamber of the cylinder 5 through the passage 26 in the control valve 19.

The operation of the apparatus is described below:

The rest or normal position is shown in FIG. 1, and the control lever 55 is not actuated so that the control chamber 34 is connected to the handle space 4 through bore 62, the annular space 61, the bore 60, the annular gap 59 and the bore 58. As the control surface 63 of the control valve 19 is greater than the lower surface which is constantly biased by the pressure within the handle 4 laterally of the holding member 24 through the openings 20, the control valve 19 is pressed downwardly and the sealing lip 31 is pressed into sealing engagement with the sealing surface 30 of the cylinder 5. The pressure space 46 at at this time is connected to the atmosphere through the passage 26, the annular space 81 and the exhaust ports 37.

Figure 2:
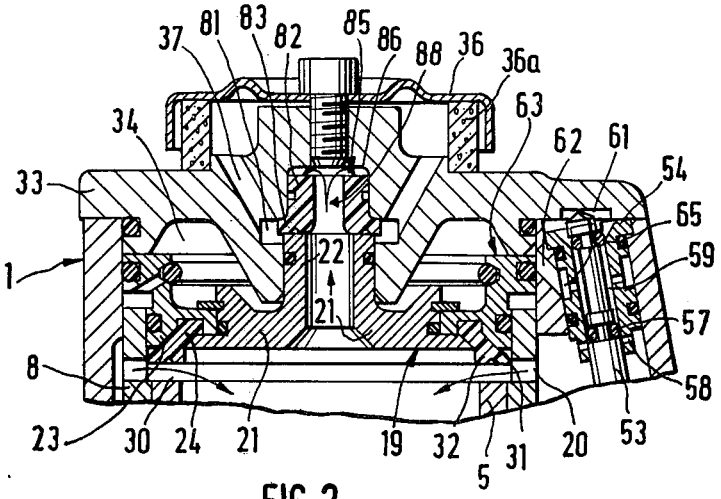
FIG. 2 is a longitudinal cross-sectional detailed view of the head of the apparatus of FIG. 1 illustrating the control valve and exhaust valve in the position during charging of the cylinder, and, FIG. 3 is a elevational sectional detailed view similar to FIG. 2 illustrating the control valve in the closed position and prior to the exhaust valve moving to the open position.

When actuating the auxiliary valve through the control lever 55 the valve rod 53 is displaced upwardly into the position as shown in FIG. 2, so that the lower sealing O-ring 57 at the rod 53 closes the control chamber 34 with respect to the handle space 4 and the chamber 34 is connected to atmosphere through the released O-ring sealing 65, so that a venting of the control chamber 34 will take place whereby the pressure effective from below will displace the control valve 19 upwardly. The holding lip 32 in this operation takes the piston 39 along with it as far as a position where the extension 22 of the control valve 19 enters into sealing engagement with the lower control surface of the exhaust valve 82 in order to block the exhaust port. Only now may a sufficient pressure build up in the chamber 46 through the bores 47 to overcome the retaining force of the holding lip 32. Thus, compressed air will not be introduced into the cylinder 5 above the piston 39 until the exhaust ports 37 have been closed.

With the build up of the pressure in chamber 46 and the cylinder the control chamber 85 will be biased with the same pressure which acts on surface 46 tending to urge the exhaust valve 82 toward the extension 22, and in this manner an effective sealing between the extension 22 and exhaust valve flange is achieved.

If the auxiliary valve returns to the position shown in FIG. 1, a pressure will again build up in the control chamber 34 biasing the control valve 19 toward the cylinder 5 in order to bring the sealing lip 31 into engagement with the end face 30 as shown in FIG. 3. The exhaust valve 82 follows the downward movement of the control valve 19 due to the pressure effective on the control surface 86 which is greater than on the opposite surface subjected to the same pressure, and the exhaust valve 82 will continue to be in sealing relationship with the extension 22 which blocks the exhaust ports 37. At the moment the sealing lip 31 sealingly engages the end face 30 the flange 83 of the exhaust valve 82 abuts against the wall 87 of the annular space 81 and is thereby prevented from further downward movement. As the holding member 24 with the sealing lip 31 is designed to be resilient, the control valve 19 continues its downward travel by a slight amount which suffices to form a gap between the exhaust valve 82 and the extension 22, FIG. 3, so that now the entire lower control surface of exhaust valve 82 will be exposed to the air pressure within the chamber 5 which overcomes the pressure on the control surface 86 and pushes the exhaust valve 82 back into the position shown in FIG. 1. Thereby, the exhaust ports 37 are now open and the working chamber above piston 39 may be vented.

Accordingly, because of the sliding movement of the exhaust valve 82 venting of the cylinder only takes place when the sealing lip 31 completely closes the ports 20, and the operation of the control valve 19 is such that there is no overlapping between the opening of the ports 20 and the closing of the exhaust ports 37, and maximum efficiency of use of compressed air is achieved and the sound level of exhausting air is reduced.

I claim:

1. A compressed air operated driver comprising, in combination, a casing, a cylinder defined within said casing having an axis and a control end, a piston reciprocally mounted within said cylinder, said cylinder, piston and control end defining a stroke chamber, a compressed air source, a manually operated first valve mounted on said casing communicating with said air source, a control valve mounted in said casing coaxial with said cylinder and defining said cylinder control end, said control valve being movable within said casing in the axial direction of said cylinder between first and second positions under the influence of said first valve, at least one port defined in said casing selectively communicating with said compressed air source and said stroke chamber, said control valve closing said port as said first position and opening said port at said second position, an exhaust port defined in said casing selectively communicating with said chamber, an exhaust valve movably mounted in said casing controlling flow through said exhaust port, said exhaust valve comprising an annular member in axial alignment with said control valve axially slidably movable within said casing, said exhaust valve including a first pressure surface and a second opposed pressure surface having a greater area than said first surface, a bore in said exhaust valve connecting said surfaces and an exhaust valve seat engaging said second surface whereby pressurized air exposed to said first surface biases said exhaust valve toward said control valve toward a position closing said exhaust port and pressurized air exposed to said second surface biases said exhaust valve in the opposite direction toward a position opening said exhaust port, said abutment selectively engaging said second surface during movement of said control valve from said first position to said second position an exhaust passage defined in said control valve communicating with said chamber and selectively communicating with said exhaust port, and an abutment defined on said control valve engaging said exhaust valve and closing said exhaust port upon said control valve moving from said first position to said second position, said exhaust valve closing said exhaust port until said control valve returns to said first position.

2. In a compressed air operated driver as in claim 1 wherein said control valve includes an annular axial projection terminating in an annular flat surface extending toward said exhaust valve, said exhaust passage being defined within said projection and said flat surface constituting said abutment.

* * * * *